US005623773A

United States Patent [19]

Bergamin

[11] Patent Number: 5,623,773

[45] Date of Patent: Apr. 29, 1997

[54] SKI BOOT HAVING A REINFORCED REAR SHAFT PORTION

[75] Inventor: Mirco Bergamin, Castelfranco, Italy

[73] Assignee: Lange International S.A., Fribourg, Switzerland

[21] Appl. No.: 298,364

[22] Filed: Aug. 30, 1994

Related U.S. Application Data

[63] Continuation of Ser. No. 97,706, Jul. 27, 1993, abandoned.

[30] Foreign Application Priority Data

Aug. 7, 1992 [CH] Switzerland ..... 2473/92

[51] Int. Cl.[6] ..... A43B 5/04; A43B 5/16

[52] U.S. Cl. ..... 36/117.1; 36/118.2

[58] Field of Search ..... 36/117–121, 89, 36/69, 68, 88, 92, 109, 114, 58.5, 58.6

[56] References Cited

U.S. PATENT DOCUMENTS

| | | | |
|---|---|---|---|
| 1,610,700 | 12/1926 | Morton | 36/89 |
| 2,936,533 | 5/1960 | Paynor | 36/69 |
| 3,854,743 | 12/1974 | Hansen | 36/121 |
| 4,085,528 | 4/1978 | Delery | 36/121 |
| 4,551,933 | 11/1985 | Morell et al. | 36/120 |
| 4,944,100 | 7/1990 | Sartor et al. | 36/120 |
| 5,177,884 | 1/1993 | Rullier | 36/89 |

FOREIGN PATENT DOCUMENTS

| | | | |
|---|---|---|---|
| 0429373 | 5/1991 | European Pat. Off. . | |
| 0430821 | 6/1991 | European Pat. Off. . | |
| 964740 | 8/1950 | France | 36/89 |
| 2330345 | 6/1977 | France . | |
| 2653310 | 4/1991 | France . | |

*Primary Examiner*—B. Dayoan

*Attorney, Agent, or Firm*—Kane, Dalsimer, Sullivan, Kurucz, Levy, Eisele and Richard, LLP

[57] ABSTRACT

A ski boot consisting of a shell (1) and of a collar (2) articulated on the shell. It comprises, between the collar and the shell, a brace (5) comprising a part in the form of an arch (14) which is integrated into the heel (16). This brace improves the transmission of stresses from the leg to the ski and therefore the edging.

13 Claims, 4 Drawing Sheets

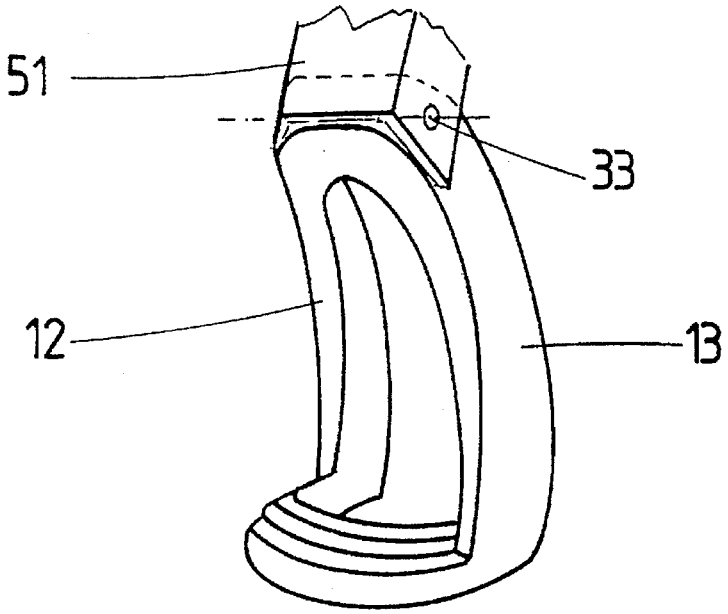
FIG. 6
FIG. 7
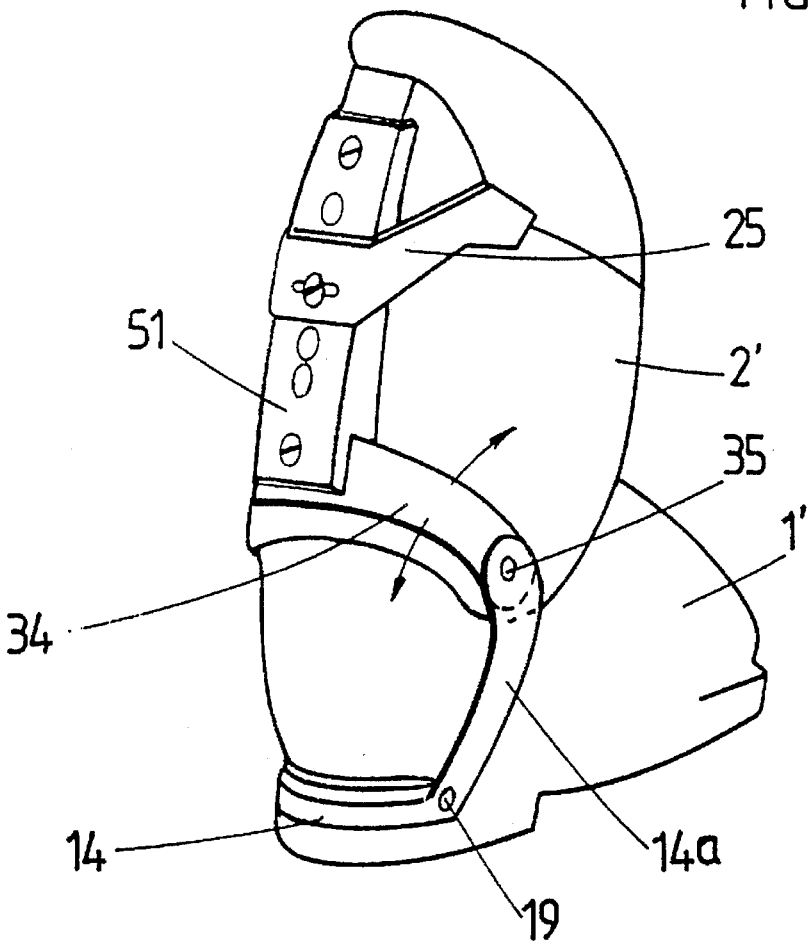

SKI BOOT HAVING A REINFORCED REAR SHAFT PORTION

This is a continuation of application Ser. No. 08/097,706 filed on Jul. 27, 1993, now abandoned.

FIELD OF THE INVENTION

The present invention relates to a ski boot made of plastic material consisting essentially of a shell surrounding the foot and the heel, of a shaft in the form of a collar articulated on the shell and of a rigid brace connecting the rear part of the collar to the shell.

PRIOR ART

From U.S. Pat. No. 4,085,528, a boot made of thermoplastic material is known, which comprises a shell and a collar connected to the shell by a U-shaped brace consisting of a steel shaft of circular cross-section. The brace has two branches extending on either side of the rear part of the collar, these branches then being elbowed obliquely towards the front to come to fit into two pieces which are integral with the shell. The aim of this brace is better to control the flexibility of the boot, independently of the inherent flexibility of the plastic material. It also makes it possible to adjust the flexibility of the boot. This structure also has the effect of increasing the torsional rigidity and consequently of improving the transmission of a torsional stress on the skis during edging on turning.

The transmission of the stresses to the ski is still, however, carried out by means of the boot, so that the rapidity and the accuracy of the transmission of the stresses to the ski is still dependent upon the rigidity of the boot. The greater the rigidity, the more rapid the response of the ski. The rigidity of the boot cannot, however, be increased without increasing the thickness of the plastic material, and therefore the cost and the weight and to the detriment of comfort. A reduction in the flexibility of the boot towards the front, which opposes the flexion of the leg, is moreover unfavorable.

SUMMARY OF THE INVENTION

The aim of the present invention is to improve the transmission of stresses to the ski in order to obtain a much more rapid response of the ski, in particular during edge changing. This aim is to be achieved independently of the characteristics of the plastic material constituting the boot, that is to say without it being necessary to increase the rigidity and/or the thickness thereof.

The ski boot according to the invention is characterised in that the brace comprises a part in the form of an arch which is integrated into the heel of the boot and fixed to the shell in an essentially horizontal plane.

The upper part of the brace could be made as shown in the Patent FR 2 330 345 or, for example, comprise a central part fixed to the back of the collar, this central part being connected by two lower arms to the ends of the arch and by two upper arms to the flanks of the collar.

Thus, any lateral tilting movement of the leg, on either side of the longitudinal parting plane of the boot, is transmitted directly to the binding, that is to the ski via the rigid brace. The ski responds immediately to any order of edge changing and edging becomes more accurate and more safe.

The brace will, in principle, be made of metal but any synthetic material having an adequate rigidity could also be used.

The arch integrated into the heel of the boot preferably constitutes the upper part of the heel and will therefore support the pressure of the heelpiece of the ski binding. The height of the part made of plastic of the heel is reduced so that the total height of the heel corresponds to the standards.

The brace can be made in one single piece or in a number of pieces.

If the brace consists of a number of pieces, these pieces can be made from different materials. It is thus possible to make the arch of rigid self-lubricating synthetic material such as TEFLON (registered trademark) so as to increase the operational safety of the ski binding when the latter is released, in particular in the event of release during torsional stress.

The brace can easily be made in interchangeable form.

BRIEF DESCRIPTION OF THE DRAWINGS

The attached drawing shows by way of example three embodiments of the invention.

FIG. 6 shows an alternative embodiment of the first embodiment.

FIG. 7 shows a third embodiment.

DESCRIPTION OF THE PREFERRED EMBODIMENT(S)

Figure 1:
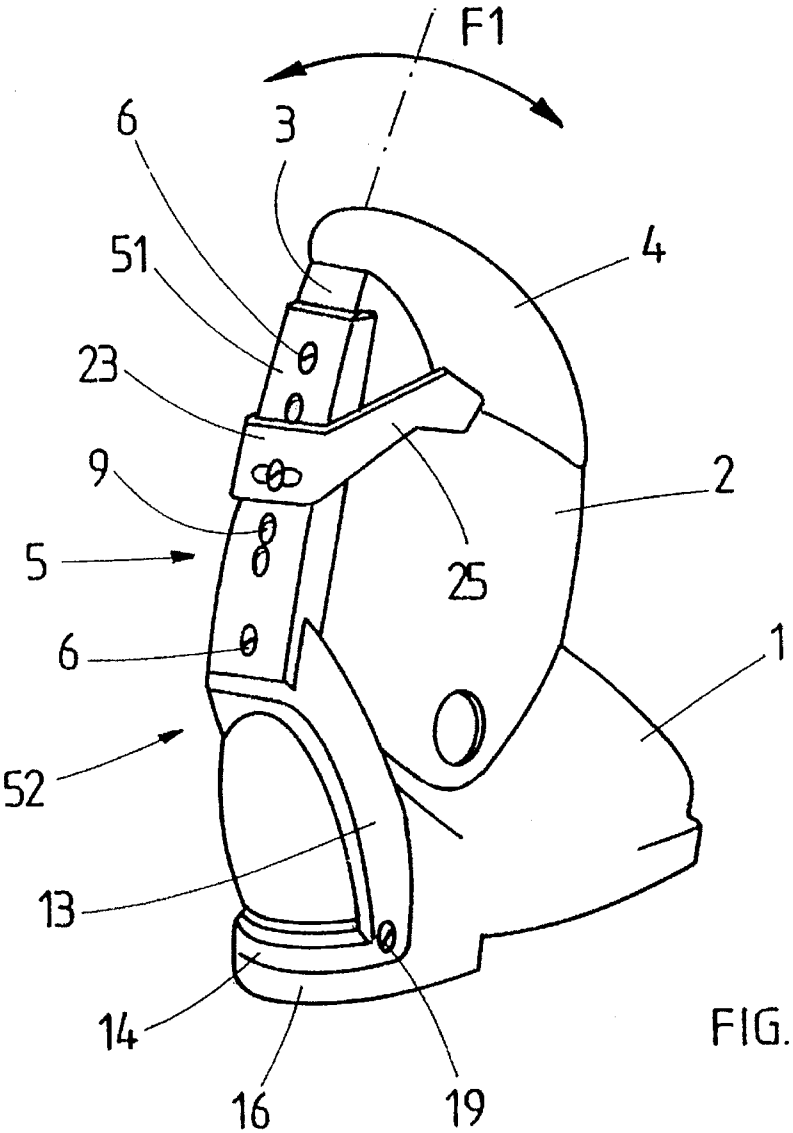
FIG. 1 is a view in perspective of a boot according to a first embodiment.
Figure 2:
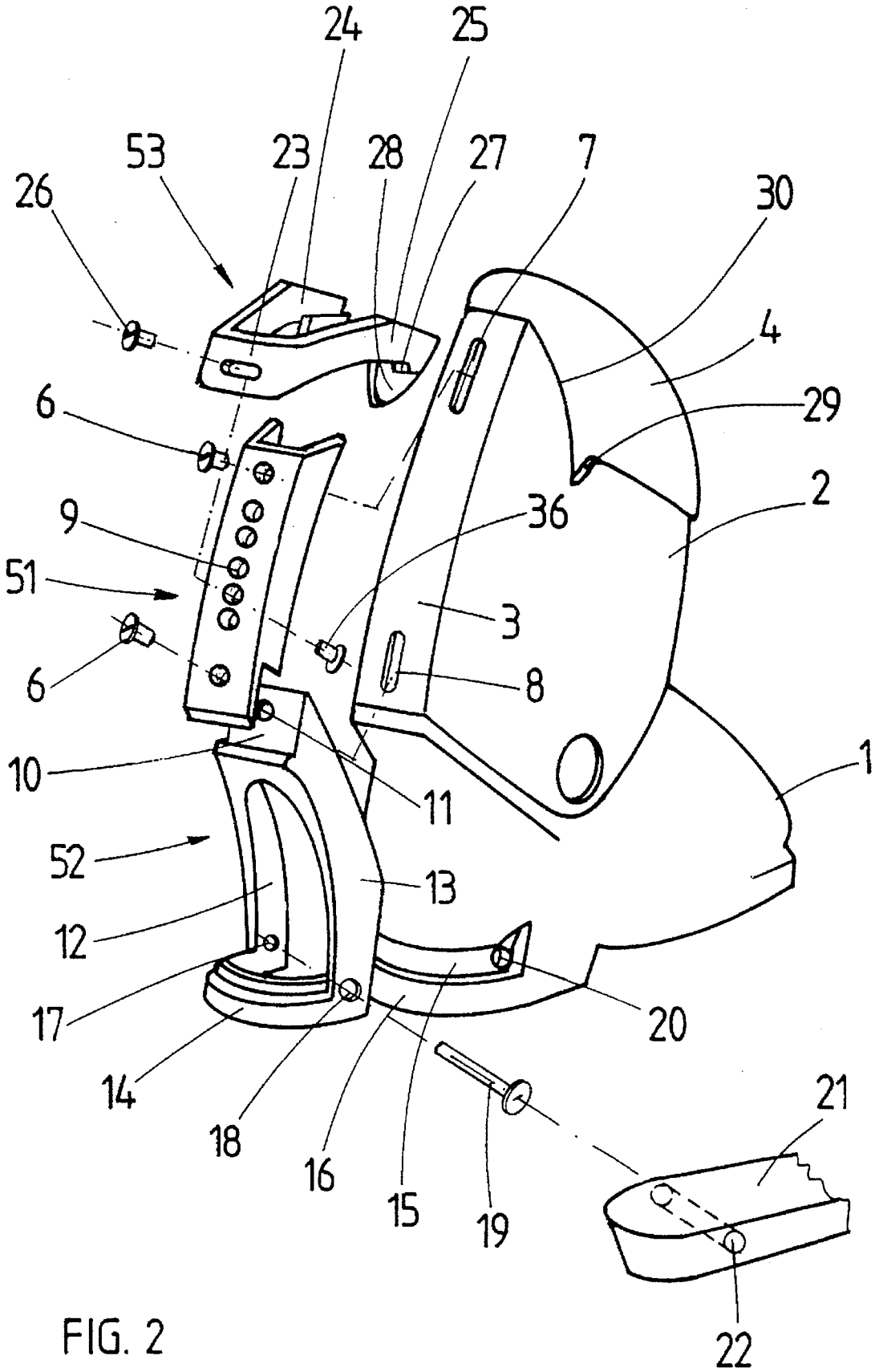
FIG. 2 shows an exploded view of the brace.
Figure 5:
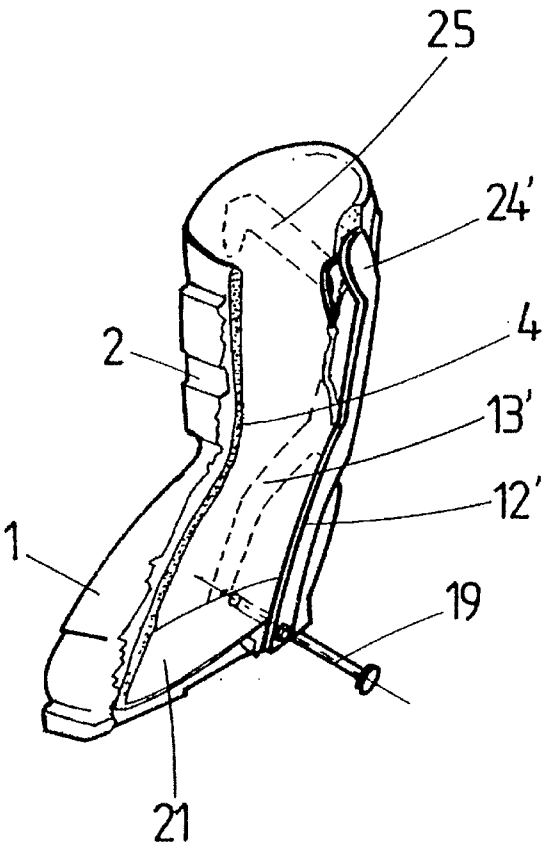
FIG. 5 is a view in perspective and in section of the second embodiment.

FIGS. 1 and 2 show diagrammatically a shell 1, on which is articulated the shaft of the boot consisting of a collar 2, the back of which has a face 3 which is plane or slightly curved about an axis transverse to the boot. The upper part of an inner boot 4 can also be seen. This type of boot is well known per se.

The boot moreover comprises a brace 5 consisting here of three pieces 51, 52, 53. The central piece 51 consists of a U-shaped profile which comes to fit onto the back of the collar 2 and be applied against its dorsal face 3. It is fixed to the collar 2 by two screws 6. The upper screw 6 passes through the back 3 through a vertical oblong hole 7 to come to be screwed into a nut inside the collar. The lower screw 6 passes through the back 3 through an oblong hole 8 to come likewise to be screwed into a fixed nut which is integral with the shell. The piece 51 moreover has a vertical row of holes 9 which serve on the one hand to lighten the piece 51 and on the other hand to allow use in a number of parts and to permit an adjustment of the flexion.

The lower piece 52 has, on its upper part, a profile 10 which comes to fit into a mating profile of the piece 51. The profile 10 has a hole 11 for the passage of the screw 6 which serves simultaneously for joining the pieces 51 and 52 and for joining the piece 52 onto the shell. The piece 52 has two arms 12 and 13 which extend on either side of the rear part of the shell 1 and are connected to an arch 14 surrounding the heel of the boot in a horizontal plane. The arch 14 comes to be accommodated in a groove 15 of the shell so as to be integrated into the heel of the boot and form the upper part of this heel, the lower part 16 of which is constituted by the plastic material of the shell. The total height of the parts 14 and 16 is equal to the standardised height of the heel and their assembled form is that of the standard. At the junction of the arms 12 and 13 and of the arch 14, the piece 52 has holes 17 and 18 for the passage of a screw 19 passing through the shell 1 via a passage 20. The screw 19 also passes through a plantar support 21 through a hole 22. The screw 19 is screwed into the tapped hole 17.

The piece 53 is in the form of a stirrup having a straight central part 23 and two arms 24 and 25 extending on each side of the collar 2. The stirrup 53 is fixed by its central part 23 to the central piece 51 in one of the holes 9 by means of a screw 26 which interacts with a nut 36. Each of the arms 24 and 25 has, at its end, a lug 27 which is directed towards the inside and bears a plate 28 at its end. Each of these lugs comes to engage in a rounded indentation 29 provided on each of the sides of the upper edge of the collar 2. The corresponding plate 28 comes to engage inside the collar so that the arms are attached to the collar both longitudinally and transversely. At the rear of the indentations 29, the edge of the collar has an ascending ramp 30.

As can be seen from FIG. 1, any tilting of the boot on either side of its central longitudinal plane, according to the double arrow F1, is transmitted directly by the arms 24 and 25 of the brace to the arch 14, that is to say to the ski binding.

The oblong holes 7 and 8, as well as the mode of attachment of the arms 24 and 25 to the collar 2, make it possible to preserve the flexibility of the boot towards the front. When a flexion stress is exerted on the collar 2, the lugs 27 can, by virtue of the flexibility of the material of the collar, be displaced slightly along the ramps 30, thus allowing flexion towards the front.

Figure 3:
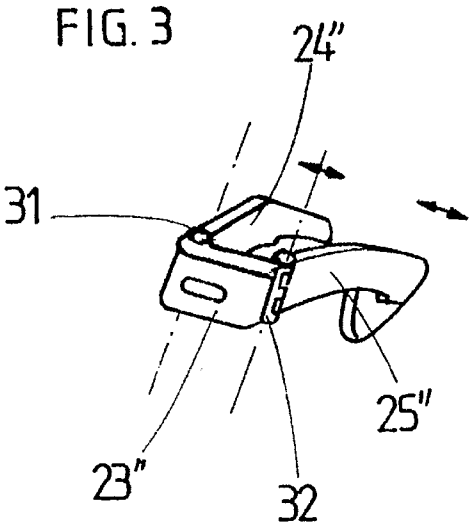
FIG. 3 shows an alternative embodiment of the upper arms of the brace.

FIG. 3 shows an alternative embodiment of the piece 53. It differs in that the arms 24' and 25' are connected to the central part 23' by hinges 31 and 32 which make it possible for the arms to be displaced according to the double arrows, and the width of the stirrup can thus adapt to the leg, that is to say to the different calf types. The transmission of the tilting movements according to F1 is not affected by these articulations as it is carried out by the piece 51.

The brace can, for example, be made of light metal alloy, of synthetic material, of composite material or of any other adequate material.

Figure 4:
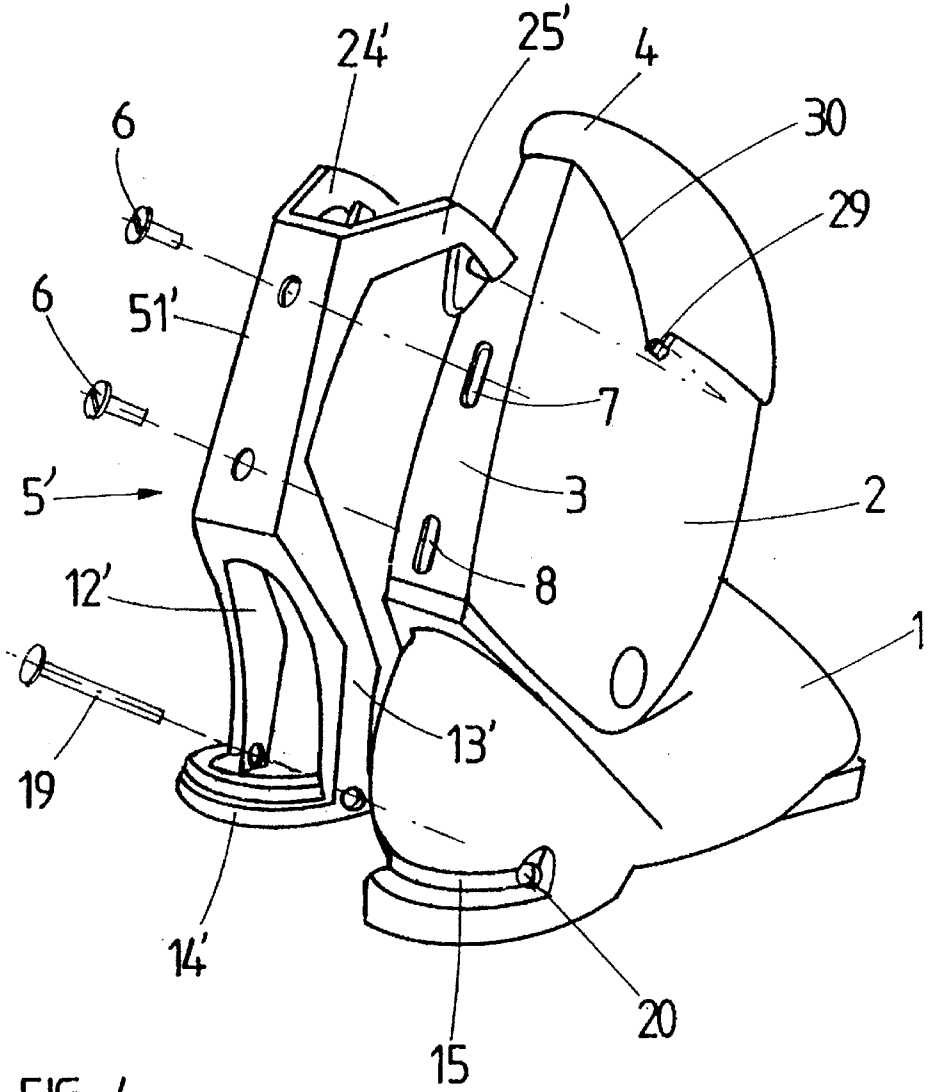
FIG. 4 is en exploded view of a second embodiment.

The brace 5 can made in one single piece. Such an embodiment 5' is shown in FIG. 4. For the rest, the brace 5' is similar to the brace 5 and, so as to avoid unnecessary repetition, the corresponding parts have been designated by the same references as in FIG. 2 with the addition of a sign '. In this case, the position of the arms 24' and 25' relative to the central part of the brace is therefore not adjustable and these arms therefore are simply situated at the upper end of the central part.

As already mentioned in the introduction, the arches 14 and 14' could be made of self-lubricating plastic material.

In order to improve the flexibility of the boot towards the front, the pieces 51 and 52 of FIG. 1 can be connected by an articulation 33 as shown in FIG. 6. The axis of this articulation is parallel to the articulation of the collar on the shell.

In the case of a boot of the MID ENTRY type (for example U.S. Pat. No. 5,033,210), that is to say a boot, the collar of which has to be capable of tilting towards the rear for putting the boot on and walking, the brace must be capable of allowing this movement. An exemplary embodiment is shown in FIG. 7. The boot consists of a shell 1', on which a collar 2' is articulated. The brace again comprises the parts 51 and 25 but the part 51 is fixed to a stirrup 34 articulated on the rivets 35 of articulation of the collar on the shell and, by these same rivets, to the ends of two arms **14*a* of the arch 14. In the skiing position, the collar 2' is locked on the shell 1' and the brace is perfectly rigid in lateral tilting. The parts 51 and 34** could be in one single piece.

I claim:

1. A ski boot for reception by a ski binding and having a heel which has a back having an upper part, the boot being made of plastic material and comprising a shell (1) for surrounding a foot and a heel of a skier, a shaft (2) in the form of a collar having a rear and being articulated on the shell (1) about an axis of articulation and a rigid reinforcing means on the rear of the boot, said reinforcing means extending from the upper part of the shaft to the heel of the boot and comprising an upper portion, a lower portion and an intermediate portion;

said upper portion extending from said upper part of said shaft to said lower part of said shaft;

said lower portion being arch shaped and extending in an essentially horizontal plane about the heel of the boot and substantially longitudinally of the shell; and said intermediate portion comprising two arms extending between said upper portion and ends of said lower portion and rigidly connected to said lower portion.

2. The boot as claimed in claim 1, wherein the intermediate portion (51; 51') of the reinforcing means has a form which is elongated in the direction of the shaft of the boot and a profile such that it envelops the rear (3) of the collar.

3. The boot as claimed in claim 1, wherein the intermediate portion (51) of the reinforcing means is articulated on the lower portion about an axis parallel to the axis of articulation of the collar on the shell.

4. A ski boot for reception by a ski binding, said boot including a heel with a back having an upper part and which has a back, the boot being made of plastic material and comprising a shell (1) for surrounding a foot and a heel of a skier, a shaft (2) in the form of a collar having a rear and being articulated on the shell (1) about an axis of articulation and a rigid brace (5; 5') connecting the rear of the collar to the shell, wherein the rigid brace comprising an arch (14; 14') which is integrated into the back of the heel of the boot and fixed to the shell in an essentially horizontal plane, the arch (14; 14') of the brace constitutes substantially the back of the heel of the boot intended to receive and transmit stresses to the ski binding particularly during edge changing, the arch having opposed ends and upwardly extending rising lateral arms having ends with an upwardly extending rising arm rigidly connected at each end of the arch, the collar having flanks and the rising lateral arms (**14*a*) having ends articulated about the axis of articulation of the collar (2') on the shell (1') and wherein the brace comprising a central part (51) fixed to the rear of the collar, this central part being equipped with two upper arms (25) connecting this central part to the flanks of the collar and with two lower arms (34) having ends articulated to the ends of the arm (14*a*) of the arch (14) about the axis of articulation of the collar (2') on the shell (1'**).

5. The boot as claimed in claim 4, wherein the central part (51) of the brace has a form which is elongated in the direction of the shaft of the boot and a profile such that it envelops the rear (3) of the collar.

6. The boot as claimed in claim 4, wherein the brace is made in one single piece.

7. The boot as claimed in claim 4, wherein the upper arms (24, 25) consist of a stirrup added to the central part (51) and fixed thereon by means of a screw, the central part having a number of holes (9) on its height which can receive said screw.

8. The boot as claimed in claim 7 wherein the stirrup itself consists of a central part (23"), and a pair of ends of which arms (24", 25") are being articulated at this pair of ends of the stirrup.

9. A ski boot having a heel which has a back, the boot being made of plastic material and comprising a shell (1) for surrounding a foot and a heel of a skier, a shaft (2) in the form of a collar having a rear and being articulated on the shell (1) about an axis of articulation and a rigid brace (5; 5') connecting the rear of the collar to the shell, wherein the rigid brace comprises an arch (14; 14') which is integrated into the back of the heel of the boot and fixed to the shell in an essentially horizontal plane, the arch having ends;

the collar having flanks and the brace moreover comprises a central part (51; 51') fixed to the rear of the collar, this central part being connected by two lower arms (12, 13; 12', 13') to the ends of the arch (14; 14') and by two upper arms (24, 25; 24', 25') to the flanks of the collar (2);

the collar having an upper edge having lateral sides, each of the lateral sides of the upper edge of the collar (2) has a rounded indentation (29) and wherein the upper arms of the brace having ends, each having a lug (27) engaging respectively in each of the indentations (29) of the collar, these lugs being equipped, at their end, with a plate (8) which engages inside the collar to bring about also the attachment of the upper arms in the transverse direction.

10. The boot as claimed in claim 9, wherein the boot has a front and the upper edge of the collar has, behind the indentations (29), ascending ramps (30) and wherein the central part of the brace if fixed to the back of the collar at a low point (8) and at a high point (7) having a vertical play, so that during flexion of a leg of a skier towards the front the lugs can be displaced slightly on the ramps by virtue of the elastic deformation of the collar, thus allowing flexion of the collar towards the front.

11. A ski boot for reception by a ski binding having a heel which has a back, the boot being made of plastic material and comprising a shell (1) for surrounding a foot and a heel of a skier, a shaft (2) in the form of a collar having a rear and being articulated on the shell (1) about axes of articulation and a rigid brace (5; connecting the rear of the collar to the shell, wherein the rigid brace comprising an arch (14; 14') which is integrated into the back of the heel of the boot and fixed to the shell in an essentially horizontal plane, the arch (14; 14') of the brace constitutes substantially the back of the heel intended to receive and transmit stresses to the ski binding particularly during edge changing, the arch having opposed ends and an upwardly extending rising arm rigidly connected at each end of the arch, wherein the collar has flanks and the brace moreover comprises a central part (51; 51') fixed to the rear of the collar, this central part being connected by two lower arms (12, 13; 12', 13') to the ends of the arch (14; 14') and by two upper arms (24, 25; 24' 25') to the flanks of the collar (2), the brace being made in one single place.

12. A ski boot having a heel which has a back having a part, the boot being made of plastic material and comprising a shell (1) for surrounding a foot and a heel of a skier, a shaft (2) in the form of a collar having a rear part and being articulated on the shell (1) about axes of articulation and a rigid brace (5; 5') connecting the rear part of the collar to the shell, wherein the rigid brace comprises a part in the form of an arch (14; 14') having ends and which is integrated into the back of the heel of the boot and fixed to the shell in an essentially horizontal plane;

the collar having flanks and the brace moreover comprises a central part (51; 51') fixed to the rear part of the collar, this central part being connected by two lower arms (12, 13; 12', 13') to the ends of the arch (14; 14') and by two upper arms (24, 25; 24' 25') to the flanks of the collar (2);

the upper arms (24, 25) consisting of a stirrup added to the central part (51) and fixed thereon by means of a screw, the central part having a number of holes (9) on its height which can receive said screw.

13. The boot as claimed in claim 12, wherein the stirrup itself consists of a central part (23") having ends, arms (24", 25") being articulated on the ends of the central part.

* * * * *